US009651306B2

(12) United States Patent
Firstenberg

(10) Patent No.: US 9,651,306 B2
(45) Date of Patent: May 16, 2017

(54) METHOD FOR DRYING SEAL MATERIALS FOR IGNITION DEVICES

(71) Applicant: FEDERAL-MOGUL IGNITION COMPANY, Southfield, MI (US)

(72) Inventor: Keith Firstenberg, Livonia, MI (US)

(73) Assignee: FEDERAL-MOGUL IGNITION COMPANY, Southfield, MI (US)

( * ) Notice: Subject to any disclaimer, the term of this patent is extended or adjusted under 35 U.S.C. 154(b) by 380 days.

(21) Appl. No.: 14/216,094

(22) Filed: Mar. 17, 2014

(65) Prior Publication Data

US 2014/0259726 A1 Sep. 18, 2014

Related U.S. Application Data

(60) Provisional application No. 61/798,317, filed on Mar. 15, 2013.

(51) Int. Cl.
*F26B 5/16* (2006.01)

(52) U.S. Cl.
CPC ..... *F26B 5/16* (2013.01)

(58) Field of Classification Search
CPC ..... F26B 5/16
See application file for complete search history.

(56) References Cited

U.S. PATENT DOCUMENTS 2,045,494 A * 6/1936 Riddle ..... H01T 13/38 313/118
3,210,272 A * 10/1965 Foster ..... F26B 5/16 210/767
3,623,233 A * 11/1971 Severinghaus ..... F26B 5/16 34/333
3,703,387 A * 11/1972 Bedford et al. ..... H01C 17/065 501/15
3,736,667 A * 6/1973 McClaren ..... F26B 17/122 34/551
4,305,743 A 12/1981 Hommel et al.
4,504,411 A 3/1985 Sakai et al.
4,713,582 A 12/1987 Yamada et al.
5,137,747 A 8/1992 Malandain et al.
5,340,776 A 8/1994 Paschke et al.
5,720,951 A * 2/1998 Baker ..... A01N 25/004 424/405
6,320,317 B1 * 11/2001 Keller ..... H01T 13/34 252/507
6,334,800 B1 1/2002 Nishikawa et al.
6,986,213 B2 1/2006 Kruithof et al.
7,414,090 B2 8/2008 Wang et al.
(Continued)

FOREIGN PATENT DOCUMENTS

DE 10136728 A1 2/2003

*Primary Examiner* — Kenneth Rinehart
*Assistant Examiner* — Logan Jones
(74) *Attorney, Agent, or Firm* — Reising Ethington, P.C.

(57) ABSTRACT

A method for drying a seal material for use in manufacturing an ignition device, e.g., a spark plug. A free-flowing or loose seal material having a moisture content is provided and brought together with a desiccant for a time sufficient to produce a dry seal material by reducing the moisture content of the loose seal material to a desired level. Thereafter, the dry seal material and the desiccant may be separated from one another so that the dry seal material can be used to form a seal within an internal bore of a spark plug.

16 Claims, 1 Drawing Sheet

(56) References Cited

U.S. PATENT DOCUMENTS

| | | | | |
|---|---|---|---|---|
| 7,443,089 | B2 | 10/2008 | Hoffman et al. | |
| 8,013,502 | B2 | 9/2011 | Hoffman | |
| 8,181,483 | B2 | 5/2012 | Davis et al. | |
| 2003/0020388 | A1* | 1/2003 | Pollner | H01T 13/34 313/145 |
| 2007/0154663 | A1 | 7/2007 | Wang et al. | |
| 2008/0299325 | A1 | 12/2008 | Davis et al. | |
| 2011/0252662 | A1 | 10/2011 | Bland et al. | |
| 2014/0144072 | A1* | 5/2014 | Bland | C10B 57/10 44/626 |
| 2014/0345153 | A1* | 11/2014 | Pahwa | F26B 21/083 34/330 |

* cited by examiner

METHOD FOR DRYING SEAL MATERIALS FOR IGNITION DEVICES

REFERENCE TO RELATED APPLICATIONS

This application claims the benefit of U.S. Provisional Ser. No. 61/798,317 filed on Mar. 15, 2013, the entire contents of which are incorporated herein.

TECHNICAL FIELD

This invention generally relates to ignition devices, and more particularly, to methods for drying seal materials used in the manufacture of ignition devices, e.g., spark plugs.

BACKGROUND

Various compositions are used in effecting a seal between a ceramic component and a metallic component of a spark plug. For example, electrically conductive, semi-conductive and resistive seal materials are used in center wire assemblies of spark plugs to provide a hermetic seal within the internal bore of the insulator and to provide an electrically conductive path between the terminal electrode and the center electrode of the spark plug. The terminal electrode and the center electrode may be directly connected to one another within the internal bore by the conductive seal material, or they may be indirectly connected by a series of electrical components that includes the conductive seal material and establishes an electrical path from the terminal electrode to the center electrode. For example, it may be desirable to seal a resistor between two electrically conductive seal layers within the internal bore of the insulator to help suppress the generation of ignition-related electromagnetic interference (EMI), also known as radio frequency interference (RFI). Additionally, the seal acts as the resistive element and helps to suppress EMI.

Electrically conductive seal materials are typically composite materials that include a combination of electrically insulating and electrically conductive materials. In general, a uniform dispersion of the insulating materials and the conductive materials is desirable. To help improve the homogeneity of powdered seal materials, these materials are sometimes formed into free-flowing granules, pellets, tablets, extrudates, or other types of aggregates, which may require addition of a liquid to the powdered materials. In such case, the granulated, pelletized, extruded, or otherwise agglomerated seal materials must be thoroughly dried before they can be introduced into an internal bore of an insulator and used to form a seal of a spark plug.

SUMMARY

According to one embodiment, there is provided a method for drying a seal material for use in manufacturing an ignition device. The method comprises the steps of: (a) providing a loose seal material having a moisture content; (b) providing a desiccant; (c) bringing the loose seal material and the desiccant together to produce a dry seal material by reducing the moisture content of the loose seal material; (d) separating the dry seal material and the desiccant; and (e) introducing the dry seal material into an internal bore of an insulator of the ignition device.

According to another embodiment, there is provided a method for drying a seal material for use in manufacturing an ignition device. The method comprises the steps of: (a) providing a granular seal material having a moisture content in the range of 3-5 wt. %, based upon the overall weight of the granular seal material; (b) providing a plurality of discrete desiccant components; (c) bringing the granular seal material and the desiccant components together; (d) maintaining the granular seal material and the desiccant components in close proximity to one another for a sufficient amount of time to produce a dry seal material by reducing the moisture content of the granular seal material to less than 1 wt. %; (e) separating the dry seal material from the desiccant components based upon a size difference between the dry seal material and the desiccant components; and (f) forming a seal for the ignition device using the dry seal material.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The method described herein may be used to dry loose or free-flowing seal materials that are used to form seals between ceramic components and metallic components of ignition devices. Such seal materials have conventionally been dried by placing the seal materials on trays and loading the trays into a forced convection hot air drying oven, but doing so typically requires large amounts of energy and time. In addition, after the seal materials are dried, the dry seal materials generally must be passed through a sieve to remove oversized seal materials. Further, if a different seal material composition is to be dried next, the trays must be cleaned and dried before they can be reused. The presently disclosed drying method involves the use of a desiccant to help remove moisture from the seal materials prior to use, which may eliminate the need for a drying oven and thus may improve the overall efficiency of the manufacturing process. Although the following description is provided in the context of an automotive spark plug, it should be appreciated the method described herein may be used with any kind of ignition device, including spark plugs, glow plugs, industrial plugs, aviation igniters and/or any other device that is used to ignite an air/fuel mixture in an engine.

Figure 1:
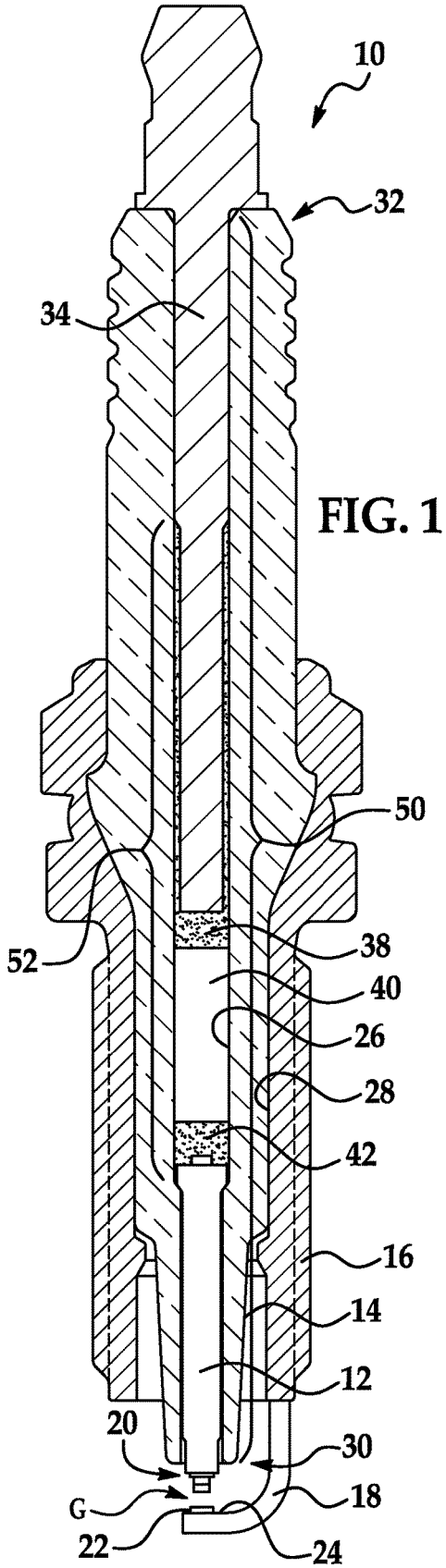
FIG. 1 is a cross-sectional view of an exemplary spark plug having a ceramic-to-metal seal, in accordance with one illustrative embodiment of the present disclosure.

An exemplary spark plug is shown in FIG. 1, where the spark plug has a seal produced in accordance with the method described herein. The spark plug 10 includes a center electrode 12, an insulator 14, a metallic shell 16, and a ground electrode 18. In the illustrated embodiment, center electrode 12 has a firing tip 20 and the ground electrode 18 has a firing tip 22 attached to the inner surface 24 of the ground electrode 18. Use of the firing tips 20, 22 is optional and is not required to form spark gap G. The center electrode 12, which is made from an electrically conducting metal like a nickel (Ni) alloy, is designed to conduct high-voltage ignition pulses and is at least partially disposed or located within an internal bore 26 of the insulator 14 that extends along the insulator axial length. The insulator 14 is an elongated component that is made from an electrically insulating material, such as a ceramic, and is intended to isolate the center electrode 12 from the metallic shell 16 so that the high-voltage ignition pulses are directed to the spark gap G. The insulator 14 is at least partially disposed or located within an internal bore 28 of the metallic shell 16, and has an operational end 30 and a terminal end 32. In the particular embodiment shown, the operational end or nose 30 extends from and protrudes beyond the end of the metallic shell 16, however, this is not necessary.

Within the internal bore 26 of the insulator 14, there are a number of components that together form a center wire assembly 50 and are designed to conduct the high-voltage ignition pulses from a vehicle ignition system to the spark gap G. In the embodiment illustrated in FIG. 1, the center wire assembly 50 includes a terminal electrode 34, a suppressor seal 52, and the center electrode 12, which was already introduced above. The suppressor seal 52 is disposed between the terminal electrode 34 and the center electrode 12 and includes an upper conductive seal layer 38, a resistor seal layer 40, and a lower conductive seal layer 42, with the resistor seal layer 40 being disposed between the two seal layers. Upper and lower end portions of the resistor seal layer 40 are in contact with the upper and lower conductive seal layers 38, 42, respectively. The resistor seal layer 40 may be made from any suitable EMI-suppressing material and, in some cases, may be made from the same materials used to make the conductive seal layers 38, 42. Accordingly, the suppressor seal 52 provides an electrically conductive path between the terminal electrode 34 and the center electrode 12, a hermetic seal within the axial bore 26 that prevents gas leakage, e.g., combustion gas leakage from the combustion chamber, while also suppressing radio frequency emissions from the spark plug 10. The suppressor seal 52 shown in FIG. 1 may be a fired in suppressor seal (FISS), which may be formed by filling the internal bore 26 of the insulator 14 with loose, granular, pelletized, or otherwise agglomerated seal materials, compressing the loose seal materials against the center electrode 12, and then heating the seal materials to a temperature at which the seal materials soften and fuse or coalesce. Although not limited thereto, the drying method described herein is particularly well suited for drying any of the components of the suppressor seal 52, especially the resistor seal layer 40. The drying method may be used with other ceramic-to-metal seals as well.

Although the spark plug 10 described above includes a suppressor seal 52 to occupy the open space between the terminal electrode 34 and the center electrode 12, other seals and arrangements are possible. For example, the space may be additionally or alternatively filled with one or more other electrical components or elements in order to provide certain desirable functionality and/or continuity between the terminal electrode 34 and the center electrode 12. Such elements may include compression springs, connecting pins, electrical contacts, resistors, capacitors, inductors, and/or other discrete electrically active components. In some embodiments, the terminal electrode 34 and the center electrode 12 may be electrically coupled together by a single electrically conductive seal layer. It should be appreciated that the drying method described herein is not limited to any particular seal or sealing material and may be used with any suitable material having a moisture content to be reduced.

Figure 2:
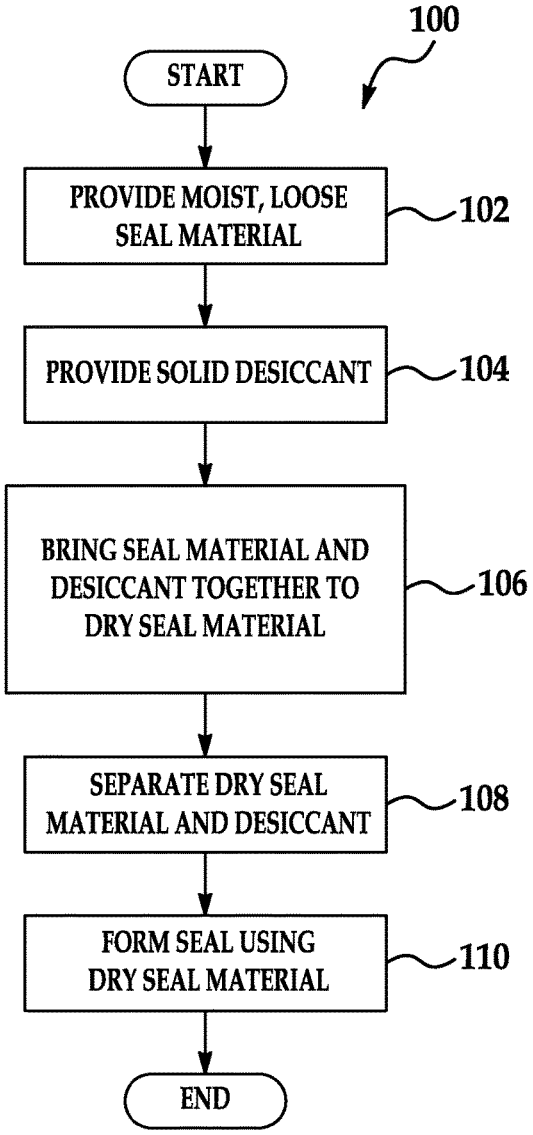
FIG. 2 is a flow chart illustrating different steps or stages of a method for forming a seal for a spark plug, including steps directed to drying a loose or free-flowing seal material.

With reference to FIG. 2, there is shown a flow chart illustrating an exemplary method 100 for manufacturing a seal for an ignition device, such as a spark plug. Beginning with step 102, the method provides a free-flowing or loose seal material. The loose seal material provided in step 102 is somewhat damp or moist, and may have a moisture content in the range of about 3 wt. % to about 5 wt. %, based on the total weight of the seal material. The moisture within the loose seal material may be water or a volatile material, and may be adsorbed on surfaces of the seal material and/or condensed on or within the seal material.

The loose seal material may be a powdered, granulated, pelletized, extruded, molded or otherwise agglomerated material. For example, a granular seal material may be formed by adding a liquid to a mixture of powdered seal material components and then agitating, mixing, or blending the seal material components with the liquid to form larger, multi-particle entities known as granules or agglomerates. The liquid may include water, a solvent, a binder, or a combination thereof. Granulating the powdered seal material components in this way may help obtain a relatively even distribution of the seal material components within the mixture and also may increase the homogeneity of seals that are formed from the mixture.

The composition of the loose seal material may vary depending on the application. In general, the loose seal material may include one or more electrically insulating materials, electrically conductive materials, or a combination of electrically insulating and electrically conductive materials. For example, the loose seal material may include glass (e.g., borosilicate glass), electrically insulating material like ceramic (e.g., alumina), electrically conductive materials such as metals (e.g., copper), carbon, fillers, or a combination thereof.

The loose seal material provided in step 102 must be dried before it is inserted into insulator bore 26 and sealed between a ceramic component and a metallic component of a spark plug. This is because, if the loose seal material is not dried before use, the generally mucilaginous qualities of the material may lead to problems during manufacturing, such as gumming up the manufacturing equipment. In addition, the presence of moisture in the loose seal material can lead to generation of vapors, e.g., steam, when the seal material is heated during the manufacturing process.

In order to help dry the loose seal material, and avoid some of the drawbacks listed above, a solid desiccant with hygroscopic properties is provided in step 104 of the process. The desiccant may be provided in several suitable forms. For example, a solid desiccant may be provided in the form of beads, powders, granules, particles, tablets, capsules, porous monoliths, or a combination thereof. If the desiccant is provided in the form of small beads, the beads may be spherical or non-spherical (e.g., irregular shapes) and may have a nominal diameter of between about 3 mm and 12 mm, for example. In some embodiments, the desiccant may be contained within another structure, package, or pouch that is permeable to moisture. The amount of desiccant provided in step 104 may be based on a number of variables, including the overall weight of the loose seal material, the moisture content of the loose seal material, and the relative humidity of the surrounding environment. For example, the desiccant may be provided in an amount from about 5 wt. % to 50 wt. % of the loose seal material, however, that is not mandatory as other amounts and ratios could be used instead.

The desiccant provided in step 104 preferably has a higher affinity for moisture than the loose seal material and thus can induce evaporation of moisture from the loose seal material. The specific choice of desiccant may vary depending on a number of factors, including the composition of the seal material, the porosity of the desiccant, lack of reactivity between the desiccant and the seal material, the size of the desiccant, and the mechanical strength of the desiccant. The desiccant preferably has sufficient mechanical strength to withstand breakage during subsequent steps 106 and 108 of this method 100. Most desiccants are classified by surface area per unit weight, and they absorb or adsorb moisture on this surface area. Thus, different types of desiccants have different capacities and absorption or adsorption constants, and this variable degree of absorption or adsorption may further impact the choice of desiccant. Non-limiting examples of solid desiccants that may be provided in step 104 include activated alumina, activated charcoal, calcium sulfate, calcium chloride, silica gel, certain clays, molecular sieves, and combinations thereof.

In step 106, the moist, loose seal material and the desiccant are brought together and are maintained in relatively close proximity to one another for a time sufficient to dry the seal material by reducing the moisture content of the seal material to a desired level, e.g., less than 1 wt. %, less than 0.4 wt. %, or nearly zero. As discussed above, the desiccant is formulated to have a higher affinity for moisture than the loose seal material, and thus will remove moisture from nearby surrounding areas such that a near-zero humidity region is created around the desiccant that encourages evaporation of moisture from the loose seal material. After the moisture content of the loose seal material has been reduced to a desired level it may be referred to as "dry." In some embodiments, a surplus of desiccant may be used, and the moisture content of the seal material may be reduced to a desired level before the saturation limit of the desiccant is reached. In other embodiments, the loose seal material and the desiccant may be held in relatively close proximity to one another until the desiccant reaches its saturation limit and the moisture content of the seal material is reduced to a target level, which may be greater than zero. The loose seal material and the desiccant may be brought into direct or indirect contact with one another, for example, by allowing the loose seal material to flow freely through the desiccant. In some embodiments, it may be desirable to bring the loose seal material and the desiccant together in a sealed environment, e.g., a container, and to store and/or transport the loose seal material and the desiccant together until just prior to use of the seal material.

In order to increase the rate at which moisture is removed from the loose seal material and to improve the uniformity of the drying process, movement may be induced between the loose seal material and the desiccant, for example, by agitating the loose seal material and the desiccant and/or by intimately mixing or stirring the loose seal material and the desiccant with one another. The loose seal material and the desiccant may be mixed with one another, for example, by sealing the loose seal material and the desiccant together in a vessel and then mechanically agitating the vessel. Such mechanical agitation may be performed inside a drum, a tumbler, or another mixing apparatus or stirring mechanism employed in the vessel itself. Placing the loose seal material and the desiccant together in a controlled environment may allow the desiccant to more efficiently direct moisture away from the loose seal material, instead of from the surrounding environment. Also, in the case of some desiccants, applying heat may help expedite moisture removal from the loose seal material; however, the application of heat may actually reduce the effectiveness of some desiccants. Thus, the use of heat to expedite or otherwise assist in the moisture removal process depends on the particular desiccant being used.

In step 108, the dried seal material and the desiccant are separated from one another. The dried seal material and the desiccant may be separated from one another, for example, based upon a size difference between the seal material and the desiccant. The dried seal material may include a plurality of granules or agglomerates having mean diameters in the range of about 50 μm to 850 μm, and the desiccant may include a plurality of discrete components that are relatively large in size, as compared to the size of the seal material granules or agglomerates. Increasing the size difference between the dried seal material and the desiccant may increase the ease at which they are separated from one another. In such case, the dried seal material and the desiccant may be separated from one another by sifting or screening out the discrete desiccant components, for example, using a Tyler 10 mesh or 20 mesh screen. Steps 106 and 108 may be repeated using fresh or recharged desiccant in order to lower the moisture content of the seal material to the desired level.

After the dried seal material and the desiccant are separated from one another, the desiccant may be "recharged" or "regenerated" by removing a sufficient amount of moisture from the desiccant so that it can be returned to step 106 and reused. This may involve washing the desiccant in water, and then heating the desiccant to evaporate moisture therefrom. The desiccant also may be washed and/or heated to remove residual materials from the desiccant. For example, it may be desirable to heat the desiccant to a sufficient temperature to decompose and remove any residual binder left behind by the seal material. The desiccant may be heated, for example, in an oven according to supplier specifications, and may be heated at a temperature in the range of 120° C. and 400° C., including all ranges and subranges therebetween. The desiccant may be heated using waste or residual heat from other manufacturing processes, which may allow the desiccant to be regenerated during off peak times of a manufacturing operation at lower operating costs. In order to determine the amount of moisture that has been removed from the seal material by the desiccant, the desiccant may weighed before and after step 106, with the difference in weigh providing a general indication as to the amount of moisture that has been removed from the seal material.

Step 106 and step 108 may be performed simultaneously such that a continuous supply of loose seal materials is prepared for use in the manufacturing process, for example. This may be accomplished by use of a bed of desiccant or discrete desiccant components. The desiccant bed may be of any convenient size or shape, and may include the use of a vibratory screening machine. In some embodiments, a layer of desiccant may be provided on a mesh screen or between two mesh screens having openings that are large enough to allow the dried seal material to pass through but are small enough to prevent passage of the discrete desiccant components. Sometimes, it may be necessary to pass the loose seal material through the desiccant bed multiple times in order to thoroughly dry the seal material. The number of times necessary to thoroughly dry the seal material may depend upon a number of variables, including the relative humidity of the processing environment, the temperature of the loose seal material and of the desiccant, the saturation level and quantity of desiccant, and the starting moisture content of the loose seal material. Furthermore, the use of a desiccant bed may be beneficial as a finishing step after the loose seal material has been mixed or agitated with the desiccant in a sealed environment.

Finally, in step 110, a seal between a ceramic component and a metallic component of a spark plug, like suppressor seal 52, is formed using the dry seal material. This step may involve introducing the dry seal material into an inner passage or bore of the spark plug, tamping or pressing the seal material, either cold pressing, hot pressing, or both, followed by firing. This process will be apparent to one having ordinary skill in the art, and could be done in accordance with the methods described in U.S. Pat. No. 7,443,089 and/or U.S. Pat. No. 8,013,502, for example, the entire contents of which are incorporated herein.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method for drying a seal material for use in manufacturing an ignition device, comprising the steps of:

(a) granulating a powdered seal material to form a loose seal material having a moisture content;

(b) providing a desiccant;

(c) bringing the loose seal material and the desiccant together to produce a dry seal material by reducing the moisture content of the loose seal material;

(d) separating the dry seal material and the desiccant;

(e) introducing the dry seal material into an internal bore of an insulator of the ignition device; and (f) regenerating the desiccant so that it may be used in a drying method, wherein the desiccant is regenerated using waste heat to drive off moisture.

2. The method set forth in claim 1, wherein said step (a) further comprises providing a loose seal material that includes at least one material selected from the group consisting of: glass, ceramic, metal, or a filler.

3. The method set forth in claim 1, wherein said step (b) further comprises providing a desiccant that has hygroscopic properties and includes at least one material selected from the group consisting of: activated alumina, activated charcoal, calcium sulfate, calcium chloride, silica gel, clay, or molecular sieves.

4. The method set forth in claim 1, wherein said step (b) further comprises providing a desiccant in an amount from about 5 wt. % to 50 wt. % of the loose seal material.

5. The method set forth in claim 1, wherein said step (b) further comprises providing a desiccant in an amount that is calculated to reduce the moisture content of the loose seal material to a target level.

6. The method set forth in claim 1, wherein said step (c) comprises bringing the loose seal material and the desiccant together in direct contact with one another.

7. The method set forth in claim 1, wherein said step (c) further comprises bringing the loose seal material and the desiccant together by mixing, stirring, or agitating the loose seal material and the desiccant and promoting a release of moisture from the loose seal material.

8. The method set forth in claim 7, wherein said step (c) further comprises mixing, stirring, or agitating the loose seal material and the desiccant in a sealed environment.

9. The method set forth in claim 1, wherein said step (c) further comprises storing the loose seal material and the desiccant together in a sealed environment.

10. The method set forth in claim 1, wherein the moisture content of the loose seal material provided in said step (a) is in the range of about 3 wt. % to 5 wt. %, based upon the overall weight of the loose seal material, and said step (c) comprises reducing the moisture content of the loose seal material to less than 1 wt. %.

11. The method set forth in claim 1, wherein step (d) further comprises separating the dry seal material and the desiccant based upon a size difference between the materials.

12. The method set forth in claim 11, wherein step (d) further comprises separating the dry seal material and the desiccant by sifting or screening out the desiccant from the dry seal material in a manner that relies upon a size difference between the materials.

13. The method set forth in claim 12, wherein the dry seal material has diameters in the range of about 50 μm to about 850 μm and the desiccant has diameters in the range of about 3 mm to 12 mm.

14. The method set forth in claim 1, further comprising the step of:

repeating steps (c) to (d) using the regenerated desiccant.

15. The method set forth in claim 1, further comprising the step of:

after step (e), heating the dry seal material and the insulator to form a seal between the insulator and a metallic component of the ignition device.

16. A method for drying a seal material for use in manufacturing an ignition device, comprising the steps of:

(a) providing a granular seal material having a moisture content in the range of 3-5 wt. %, based upon the overall weight of the granular seal material;

(b) providing a plurality of discrete desiccant components;

(c) bringing the granular seal material and the desiccant components together;

(d) maintaining the granular seal material and the desiccant components in close proximity to one another for a sufficient amount of time to produce a dry seal material by reducing the moisture content of the granular seal material to less than 1 wt. %;

(e) separating the dry seal material from the desiccant components based upon a size difference between the dry seal material and the desiccant components;

(f) forming a seal for the ignition device using the dry seal material; and (g) regenerating the desiccant so that it may be used in a drying method, wherein the desiccant is regenerated using waste heat to drive off moisture.

* * * * *